US005791113A

United States Patent [19]

Glowa et al.

[11] Patent Number: 5,791,113

[45] Date of Patent: Aug. 11, 1998

[54] STRUCTURAL CONNECTING AND SEALING MEMBER

[75] Inventors: Terry J. Glowa; Michael D. Glowa, both of St. Andrews; Dennis F. Pickerl, Winnipeg, all of Canada

[73] Assignee: Inkster Park Millwork Ltd., Winnipeg, Canada

[21] Appl. No.: 673,259

[22] Filed: Jun. 28, 1996

[51] Int. Cl.[6] ..... E04B 2/00

[52] U.S. Cl. ..... 52/586.2; 52/211; 52/212; 403/298

[58] Field of Search ..... 52/586.2, 211, 52/212, 204.1, 213; 403/298, 292

[56] References Cited

U.S. PATENT DOCUMENTS

| | | | |
|---|---|---|---|
| 2,317,231 | 4/1943 | Swedman | 403/298 X |
| 2,616,531 | 11/1952 | Young | 52/211 |
| 4,086,739 | 5/1978 | Hall | 52/586.2 X |
| 4,361,979 | 12/1982 | Peterson | 403/292 X |
| 4,454,699 | 6/1984 | Serobl | 403/298 X |
| 5,062,250 | 11/1991 | Buzzella | 52/586.2 |
| 5,261,756 | 11/1993 | Kohn | 403/292 X |
| 5,398,468 | 3/1995 | Erikson | 52/586.2 X |
| 5,528,869 | 6/1996 | Boomer et al. | 52/212 |

FOREIGN PATENT DOCUMENTS

| | | | |
|---|---|---|---|
| 672162 | 10/1989 | Switzerland | 52/213 |

*Primary Examiner*—Carl D. Friedman
*Assistant Examiner*—W. Glenn Edwards
*Attorney, Agent, or Firm*—Merchant, Gould, Smith, Edell, Welter & Schmidt

[57] ABSTRACT

A structural connecting and sealing member is provided for making a structural connection between two structural members along an elongate interface without the need for any additional fasteners. The member includes two attaching members for attaching the connecting member to each of the structural members, and further includes a sealing portion which provides a seal along a joint between the two structural members thereby eliminating the need for caulking or sealant to be applied to the joint. The member is particularly suited for use in the construction of door frames where it is used to join a door jamb to a brick mold.

24 Claims, 4 Drawing Sheets

STRUCTURAL CONNECTING AND SEALING MEMBER

FIELD OF THE INVENTION

The invention relates to a connecting member for securing together two structural members such as a brick mould and door jamb.

BACKGROUND OF THE INVENTION

A door frame typically consists of door jambs, brick moulds and a door sill. Each door jamb is attached to a corresponding brick mould which serves to hide the interface between the door frame and the surrounding walls. Traditionally, the door jambs and brick moulds have been made using solid or finger-jointed wood, and have been attached together with nails. These wooden door frames require painting to hide the nails and prevent them from rusting and to protect the wood from rotting. Caulking is required to seal the joint between the brick mould and the door jamb from weather effects.

SUMMARY OF THE INVENTION

It is an object of the invention to provide a novel member for securing two structural members together.

According to a first broad aspect, the invention provides a connecting member for providing a structural connection between a first structural member having a first interface surface and a second structural member having a second interface surface; the connecting member being elongate and comprising in cross section: a relatively rigid first attaching member extending from the bridging member for insertion into a first slot in the first interface surface of the first structural member; a relatively rigid second attaching member extending from the bridging member for insertion into a second slot in the second interface surface of the second structural member; a relatively flexible sealing member connected to the bridging member for providing a seal adjacent the first and second interface surfaces.

A major advantage of the invention is that the connecting member connects the first structural member to the second structural member without the use of nails, screws, or any other exposed fasteners which puncture the structural members. This simplifies the construction, and reduces the maintenance of the final structure. This is particularly the case where the structural members are maintenance free.

In addition, the presence of the sealing strip eliminates the requirement of the extra step of depositing caulking in the joint between the two structural members in order to weather seal that joint.

BRIEF DESCRIPTION OF THE DRAWINGS

A preferred embodiment of the invention will now be described with reference to the attached drawings in which.

DETAILED DESCRIPTION OF THE PREFERRED EMBODIMENT

Figure 1A:
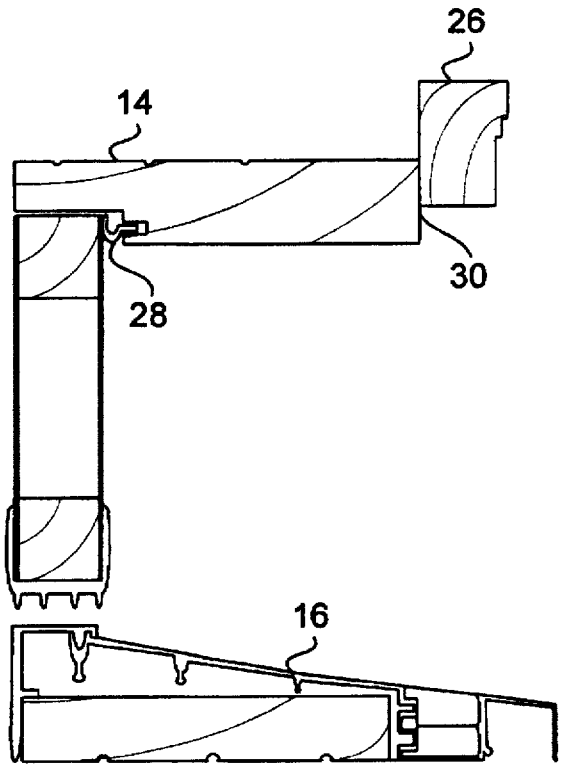
Fig. 1A Prior Art
FIGS. 1*a* and 1*b* are vertical and horizontal sectional views respectively of a typical prior art door frame.
Figure 1B:
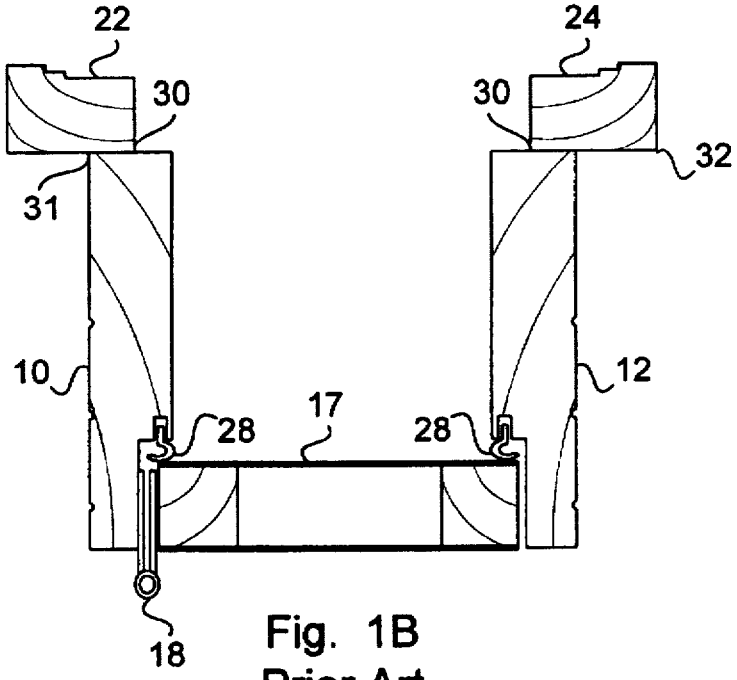
Fig. 1B Prior Art

Referring firstly to FIGS. 1*a* and 1*b*, shown in vertical and horizontal section respectively is an example of a typical prior art door frame construction. Two spaced vertical door jambs 10,12, a header 14 and a horizontal sill 16 define an opening for door 17. The door jambs 10,12, the header 14 and the sill 16 together form a door frame to which the door is mounted with hinges 18. To each of the door jambs 10,12, and the header 14 is attached a corresponding brick mould 22,24,26 which serves to hide the interface between the door frame and the surrounding walls (not shown). Each brick mould is typically attached to its corresponding door jamb with nails. Caulking is then typically applied to either or both of joints 30,31 between the door jambs 10,12, and header 14 and the corresponding brick moulds 22,24,26 to prevent moisture from leaking through. Caulking is usually applied to joint 32 between the brick moulds 22,24,26 and the surrounding walls (not shown). Foam or rubber weather stripping 28 cushions and seals the door 17 against the door jambs 10,12,and header 14 when the door is closed.

Figure 2:
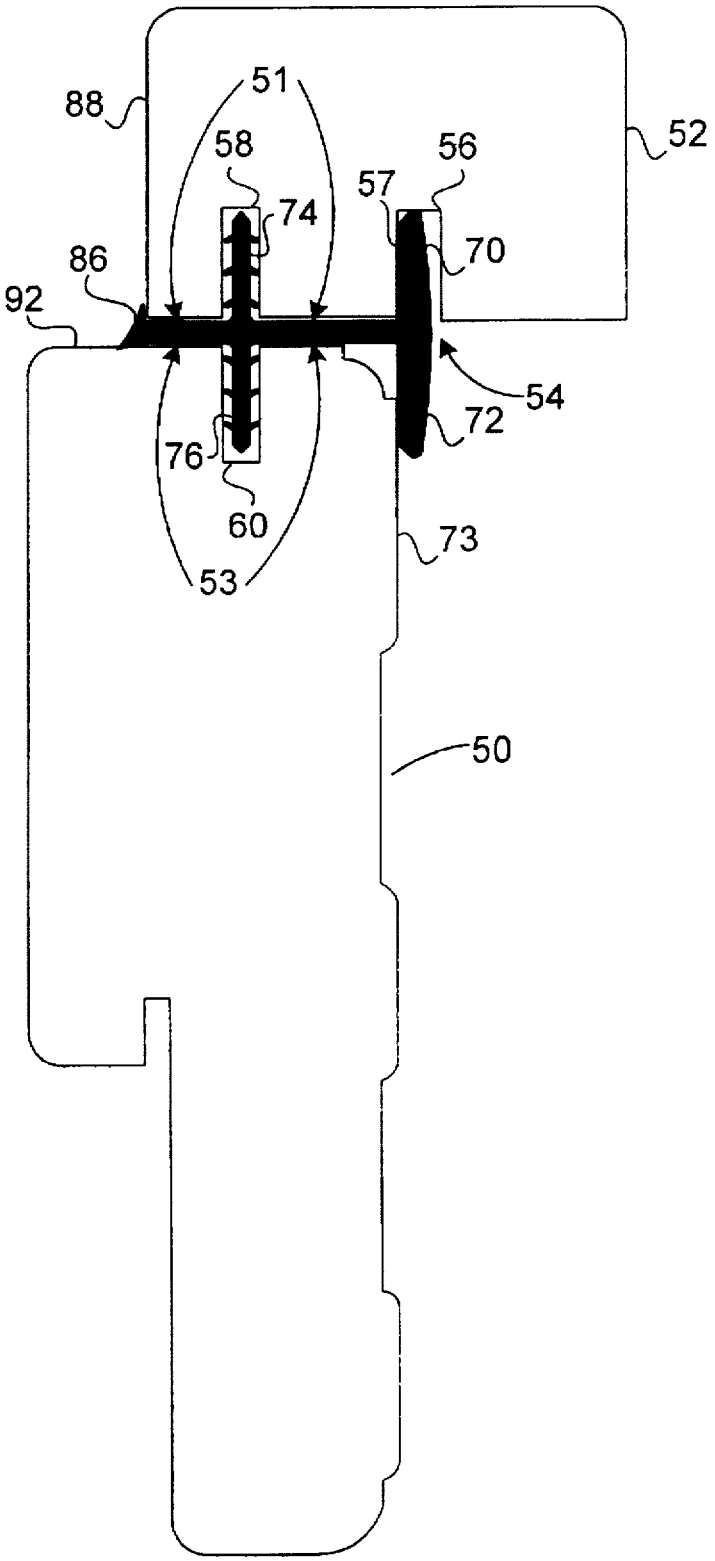
FIG. 2 is a cross-sectional view of a brick mould and door jamb attached with a connecting member according to the invention.

Referring now to FIG. 2, a connecting member 54 constructed according to the invention is shown connecting a first structural member to a second structural member which, in the illustrated embodiment, consist of a door jamb 50 (or header) and a brick mould 52 respectively. The structural members typically are made of wood which may be solid or finger jointed. Other materials may be used. For example, the structural members may be made from engineered or processed wood which may be wrapped with a vinyl coating or painted with a protective paint. The door jamb 50 has an interface surface 53 and the brick mould 52 has an interface surface 51. The connecting member 54 is an elongated member which runs the entire length of the connection between the door jamb and brick mould.

Figure 3:
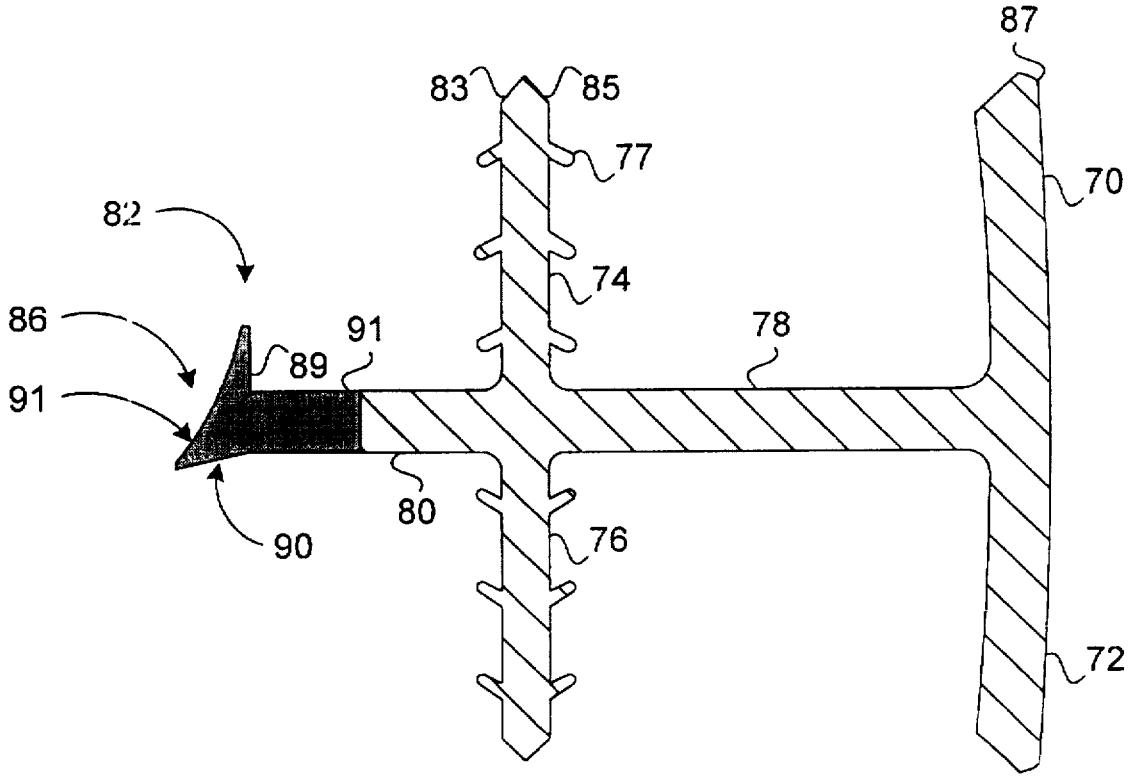
FIG. 3 illustrates an enlarged view in cross-section of the connecting member of FIG. 2.
Figure 4:
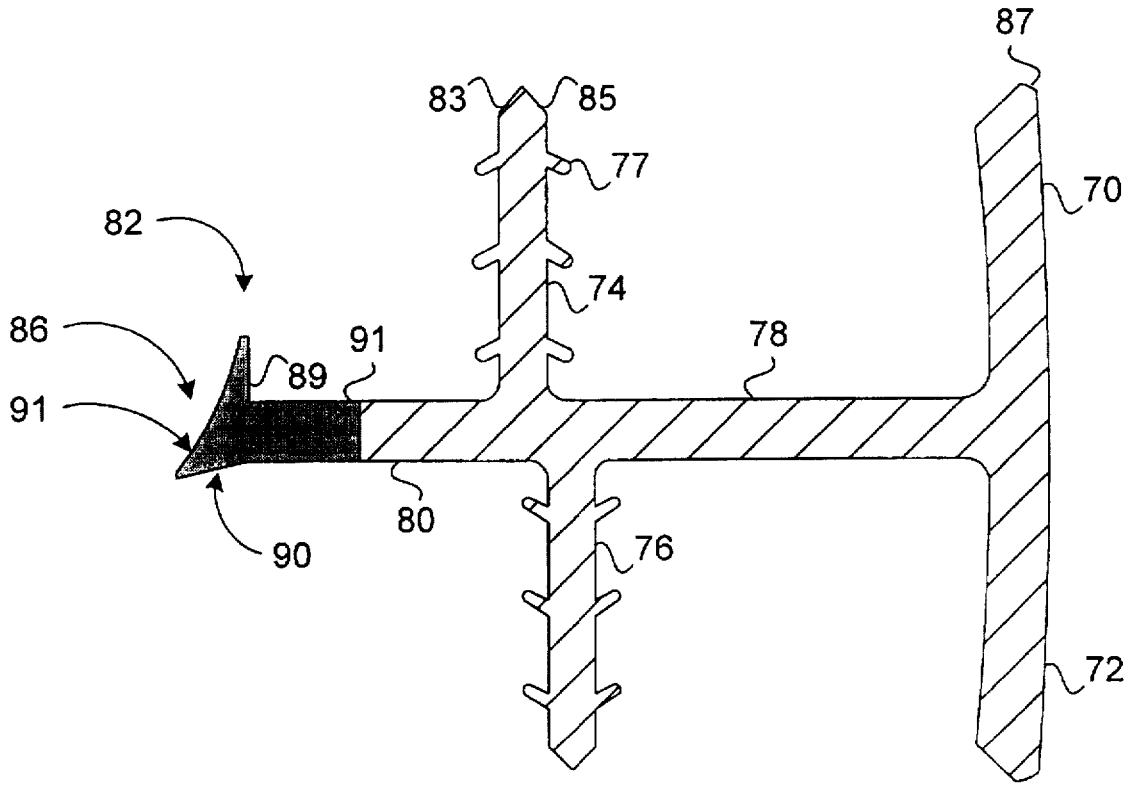
FIG. 4 illustrates a connecting member according to another embodiment of the invention.

Further details of the connecting member 54 are shown in FIG. 3. The connecting member 54 as illustrated includes a generally "H" shaped portion consisting of two stabilizing members which in the illustrated embodiment are stabilizing walls 70,72, two attaching members which in the illustrated embodiment are attaching walls 74,76, and a bridging wall 78. The two stabilizing walls 70,72 extend from two points opposite each other on opposing faces of the bridging member and are biased slightly in the direction of attaching walls 74,76. The two attaching walls 74,76 are spaced from the stabilizing walls and are shown extending perpendicularly from two points opposite each other on opposing faces of the bridging member. Walls 74,76 have ridges 77 which point generally towards bridging wall 78. In the illustrated embodiment, walls 70,72,74,76 are all of the same length but this is not essential. To provide added strength to attaching walls 74,76, they may be made thicker than stabilizing walls 70,72 as illustrated. Extending from one side of the "H" is a sealing strip connecting wall 80 connected to a sealing strip 82. In the illustrated embodiment, wall 80 is coplanar with bridging wall 78.

Sealing strip 82 has a coplanar portion 91 which is coplanar with the wall 80, and a head portion 86 for sealing a joint between the first structural member and the second structural member when they are connected with the connecting member. The head portion 86 shown is approximately triangular in shape having two flat sealing sides 89,90 joined by an arcuate side 91. More generally, sealing side 89 is shaped to conform with a side of the first structural member forming the joint, and sealing side 90 is shaped to conform with a side of the second structural member. The head portion may also be shaped so as to be biased against the sides forming the joint. By making the angle between sealing sides 89 and 90 larger than the angle between the sides forming the joint, the sides 89, 90 will be biased sealingly against the sides of the joint. For example, in the illustrated embodiment the head portion is designed to be used to seal a right angle shaped joint. The angle between sealing sides 89 and 90 is larger than a right angle thereby causing the sides to be biased against the sides of the joint.

The respective locations of the attaching walls and stabilizing walls and the distances there between, determine where slots must be formed in the structural members so they may be connected with the connecting member. In order to facilitate insertion of each of walls 70,74,76 into slots formed in the structural members, the walls may be tapered at their ends. In the illustrated embodiment, the end of attaching wall 74 is tapered at approximately 45 degrees with two sides 83,85 converging to a point. Similar tapering is illustrated for attaching wall 76. The end of stabilizing wall 70 is shown tapered at approximately 45 degrees on only one side 87. Similar tapering is illustrated for stabilizing wall 72.

The connecting member is preferably a relatively rigid vinyl extruded "HI" portion with a relatively flexible co-extruded sealing strip 82. It is preferably made of dual durometer PVC (vinyl).

Referring again to FIG. 2, in assembled form stabilizing wall 70 of the connecting member presses firmly against side 57 of slot 56 and attaching wall 74 of the connecting member 54 fits into slot 58, slots 56 and 58 being formed in the interface surface 51 of the brick mould 52. Stabilizing wall 72 of the connecting member presses firmly against side 73 the door jamb 50, and attaching wall 76 of the connecting member fits into slot 60 formed in the interface surface 53 of the door jamb 50. The ridges on walls 74,76 are designed to engage the walls of the slots 58,60 to prevent the connecting member from being disengaged from the door jamb or brick mould once installed. The stabilizing walls 70,72 provide stability and further strength to the connection. This results in a firm attachment of the brick mould to the door jamb without requirement for the use of any nails or adhesives.

Sealing strip connecting wall 80 connects sealing strip 82 to the rest of the connecting member 54 with the head portion 86 of the sealing strip forming a seal of the right angle joint formed between side 88 of the brick mould 52 and side 92 of the door jamb 50. Sealing side 89 of the head portion is sealingly biased against side 88 of the brick mould, and sealing side 90 of the sealing strip is sealingly biased against side 92 of the door jamb.

To construct a door frame with a connecting member according to the invention, the door jambs are cut and machined to size and nailed together with the sill to form the door frame. Then the connecting members are pressed or tapped into the slots of lengths of brick mould. The brick mould lengths are then cut or mitered to the correct size, and the exposed walls of the connecting member are tapped onto the slots of the assembled door jamb (door frame).

The connecting member performs a dual function which includes attaching the brick mould to the door jamb without the need for any exposed fasteners, and sealing the brick mould to the door jamb, eliminating the need for caulking.

Numerous modifications and variations of the present invention are possible in light of the above teachings. It is therefore to be understood that within the scope of the appended claims, the invention may be practised otherwise than as specifically described herein.

Although the illustrated embodiment shows a connecting member applied to the connection of a brick mould to a door jamb, it is more generally applicable to joining two structural members along an elongate interface.

The described embodiment employs one unridged stabilizing wall and one ridged attaching wall to interface with each of the two structural members, but additional ridged attaching walls or unridged stabilizing walls may be added for extra strength so long as corresponding slots are made in the structural members. It is preferred that the ridged walls be opposite each other and perpendicular to the bridging member, but this is not essential. They could extend at other angles and may extend from staggered points on the bridging member. The precise shape and configuration of the ridges on the attaching walls of the connecting member is not essential to the invention. Ridges could be perpendicular to the walls on which they are formed, although ridges which initially point generally towards the bridging wall assist in the insertion of the walls into the slots, and this is preferred. What is required is that the ridges are long enough and stiff enough to engage the sidewalls of a slot in the structural members such that the attaching wall cannot be pulled out once it is inserted in the slot. It may be that ridges will be located on a single side of each attaching wall.

Regarding the stabilizing walls, these are a preferred but not essential feature. There may be situations where the ridged walls provide sufficient structural integrity for the connection without the presence of the stabilizing walls. While it is preferred that the two stabilizing walls extend at points opposite each other on the bridging member, they may extend from staggered positions. In the case in which no stabilizing walls are employed, the bridging member is no longer essential. In this case, it may be necessary to have the structural members shaped such that there is no gap where the bridging member would have been located, thereby ensuring stability of the joint.

Although the connecting member according to the invention allows for the connection of structural members without the use of any additional adhesives or nails, adhesives may be used if desired to add further strength to the connection. It is preferred that nails not be used because they puncture the structural members and require maintenance. In some cases, adhesives alone may be used to connect attaching members which have no ridges whatsoever.

The particular nature of the tapering for each of the walls of the connecting member is not essential to the invention. The important consideration is that the walls of the connecting member must be able to be tapped into the slots without becoming stuck in the slots before reaching their full depth. Possible shapes for the ends of the walls include square with rounded corners, rounded, or pointed. In the case that the materials used for the brick mould and door jamb are such that connecting member walls with square ends can be tapped into the slots without getting stuck, no tapering or rounding of the ends of the walls is required.

The illustrated embodiment connects two structural members and provides a seal at a right angled joint. More generally, the seal could be provided for a joint having any predetermined angle by using an appropriately shaped head portion of the sealing strip. For example, the two sides forming the joint may be coplanar in which case after joining they become continuous surface. In this case, the angle between the two sealing sides of the head portion would be 180 degrees, and preferably slightly more than 180 degrees so that the sealing sides are biased against the sides forming the joint. The head portion of the sealing member as described is shaped such that it has the appearance of a conventional caulking bead but this is not essential to providing a good seal.

The combined length of the bridging member, sealing strip connecting wall, and coplanar portion of the sealing strip taken together is preferably coextensive with the length of the two interface surfaces, but is not limited to being that size. It is possible that the bridging member might extend beyond one of the interface surfaces, provided that the surface of the structural member which includes that interface surface also extends beyond that interface surface at least as far as does the extended portion of the bridging member. Additional attaching or stabilizing walls may be located on the extended portion of the bridging member.

The sealing strip connecting wall in the illustrated embodiment is coplanar with the bridging wall, and essentially a continuation thereof. This sealing strip connecting wall is not an essential feature when the coplanar portion of the sealing strip is made to extend all the way to the bridging member. The coplanar portion of the sealing strip does not necessarily have to be coplanar with the bridging member but instead could be at an angle therefrom.

While the connecting member is preferably made of co-extruded dual-durometer PCV, other materials are possible. For example, polymers other than PCV may be used. Materials such as nylon, fiber glass and aluminum may be used for the entire connecting member with the exception of the sealing strip which needs to be made of a flexible material.

The embodiments of the invention in which an exclusive property or privilege is claimed are defined as follows:

1. A connecting member for providing a structurally sound connection between a first structural member having a first interface surface and a second structural member having a second interface surface;

the connecting member being elongate and comprising in cross section:

a relatively rigid first attaching member extending from a relatively rigid bridging member for insertion into a first slot in the first interface surface of the first structural member;

a relatively rigid second attaching member extending from the bridging member for insertion into a second slot in the second interface surface of the second structural member;

a relatively flexible sealing member connected to the bridging member and having a head portion which is approximately triangular in cross-section for providing a weather seal adjacent to the first and second interface surfaces;

a first holding means on the first attaching member to hold the first attaching member in the first slot once inserted and a second holding means on the second attaching member to hold the second attaching member in the second slot once inserted.

2. The connecting member of claim 1 wherein the bridging member is disposed between the first interface surface and the second interface surface when in use.

3. The connecting member of claim 2 made of extruded PVC.

4. The connecting member of claim 2 wherein the first attaching member comprises a first wall and wherein the first holding means comprises at least one ridge extending from the first wall for engagement with a sidewall of the first slot; and wherein the second attaching member comprises a second wall and wherein the second holding means comprises at least one ridge extending from the second wall for engagement with a sidewall of the second slot.

5. The connecting member of claim 2 wherein the first attaching member comprises a first wall and wherein the first holding means comprises at least one pair of ridges, the pair extending from two points on opposite faces of the first wall for engagement with sidewalls of the first slot; and wherein the second attaching member comprises a second wall and wherein the second holding means comprises at least one pair of ridges, the pair extending from two points on opposite faces of the second wall for engagement with sidewalls of the second slot.

6. The connecting member of claim 5 wherein each of the ridges points generally towards the bridging member.

7. The connecting member of claim 5 wherein the first wall and the second wall are substantially coplanar, and are perpendicular to the bridging member.

8. The connecting member of claim 6 wherein the first wall and the second wall extend from spaced apart locations on opposite sides of the bridging member.

9. The connecting member of claim 2 further comprising a stabilizing member extending from the bridging member from a spaced apart location from the first attaching member.

10. The connecting member of claim 9 wherein the stabilizing member is a wall for placement against an external wall of one of the structural members or against a wall of an additional slot in one of the structural members.

11. The connecting member of claim 2 comprising at least two stabilizing members which extend from points opposite each other on the bridging member.

12. The connecting member of claim 3 comprising at least two stabilizing members which extend from spaced apart locations on opposite sides of the bridging member.

13. The connecting member of claim 9 wherein the attaching members and stabilizing member each have a rounded or tapered end.

14. The connecting member of claim 11 wherein the stabilizing members are slightly biased away from being perpendicular to the bridging member in a direction towards the attaching members.

15. The connecting member of claim 2 wherein the sealing member has a coplanar portion for disposition between the first and second interface surfaces;

the connecting member further comprising a relatively rigid sealing member connecting wall which is coplanar with the coplanar portion of the sealing member for connecting the coplanar portion of the sealing member to the bridging member.

16. The connecting member of claim 15 wherein the coplanar portion, the sealing member connection wall and the bridging member together are coextensive with the interface surfaces.

17. The connecting member of claim 16 wherein the triangular head portion has a first sealing side which is to be substantially parallel with a first exterior surface of the first structural member, a second sealing side which is to be substantially parallel with a second exterior surface of the second structural members and a third side.

18. The connecting member of claim 16 wherein the triangular head portion has a first sealing side which is to be substantially parallel with a first exterior surface of the first structural member, a second sealing side which is to be biased slightly away from being parallel with a second exterior surface of the second structural member in a direction towards the second exterior surface, and a third side.

19. The connecting member of claim 18 wherein the angle between the first sealing side and the second sealing side of the head portion is slightly greater than 90 degrees, the head portion thereby being suitable for sealing a right angled joint, and wherein the third side of the head portion is arcuate, so as to emulate caulking when in use.

20. The connecting member of claim 18 wherein the angle between the first sealing side and the second sealing side is slightly greater than 180 degrees, thereby forming a head portion suitable for sealing a flat joint.

21. The connecting member of claim 2 in combination with the first structural member and the second structural member, wherein the first structural member is a brick mould and the second structural member is a door jamb.

22. A connecting member for providing a structural connection between a first structural member having a first interface surface and a second structural member having a second interface surface;

the connecting member being elongate and comprising in cross-section;

a substantially H-shaped portion defined by a relatively rigid bridging member, two aligned relatively rigid attaching members extending in opposite directions from the bridging member and two aligned relatively rigid stabilizing members extending in opposite directions from a first end of the bridging member;

the attaching members each having a plurality of ridges pointing generally towards the bridging member; and a relatively flexible sealing member connected to a second end of the bridging member, the sealing member having a head portion which is approximately triangular in cross-section.

23. The connecting member of claim 22 wherein the stabilizing members extend at slightly less than 90 degrees with respect to the bridging member.

24. The connecting member of claim 22 in combination with a first structural member and a second structural member;

the first structural member having two slots extending inwardly of one surface and the second structural member having one slot extending inwardly of one surface, the bridging member being interposed between a portion of the two surfaces, the two attaching members being secured in one of the slots of the structural member and in the slot of the second structural member, one of the stabilizing members being received in the slot of the first structural member and the other stabilizing member lying against an outer surface of the second structural member, and the sealing member lying against the structural members adjacent the portion of the two surfaces.

* * * * *